United States Patent [19]

Sakai et al.

[11] Patent Number: 4,482,475

[45] Date of Patent: Nov. 13, 1984

[54] RESISTOR COMPOSITION FOR RESISTOR-INCORPORATED SPARK PLUGS

[75] Inventors: Masao Sakai, Kasugai; Yasuhiko Suzuki, Aichi; Makoto Sugimoto, Nagoya, all of Japan

[73] Assignee: NGK Spark Plug Co., Ltd., Nagoya, Japan

[21] Appl. No.: 514,328

[22] Filed: Jul. 15, 1983

[30] Foreign Application Priority Data

Jul. 21, 1982 [JP] Japan ..... 57-125733

[51] Int. Cl.[3] ..... H01B 1/06

[52] U.S. Cl. ..... 252/506; 252/507; 252/508; 252/509; 252/504; 252/510; 252/511; 338/20

[58] Field of Search ..... 252/506, 507, 508, 509 252/504, 510, 511; 338/20; 315/58; 313/136, 144, 145

[56] References Cited

U.S. PATENT DOCUMENTS

| | | | |
|---|---|---|---|
| 2,886,476 | 5/1959 | Dumesnil et al. | 252/509 |
| 3,408,524 | 10/1968 | Blum et al. | 252/512 X |
| 3,525,894 | 8/1970 | Blum | 252/512 X |
| 3,562,186 | 2/1971 | Kesten et al. | 313/136 |
| 3,562,187 | 2/1971 | Abdella | 313/144 |
| 3,909,459 | 9/1975 | Friese et al. | 252/509 |
| 4,001,145 | 1/1977 | Sakai et al. | 252/512 |
| 4,006,106 | 2/1977 | Yoshida et al. | 252/512 |
| 4,173,731 | 11/1979 | Takagi et al. | 252/506 |

*Primary Examiner*—Josephine Barr

*Attorney, Agent, or Firm*—Wegner & Bretschneider

[57] ABSTRACT

A resistor composition for spark plugs comprises 100 wt parts of base mixture of 30–70 wt glass frit with the balance being an inorganic aggregate, 0.1–10 wt parts of carbonaceous material calculated as carbon, 0–30 wt parts of stabilizing agent for resistance under load and 0.1–15 wt parts of boron, boric acid and/or a borate. This composition reduces pores on sealing.

3 Claims, 1 Drawing Figure

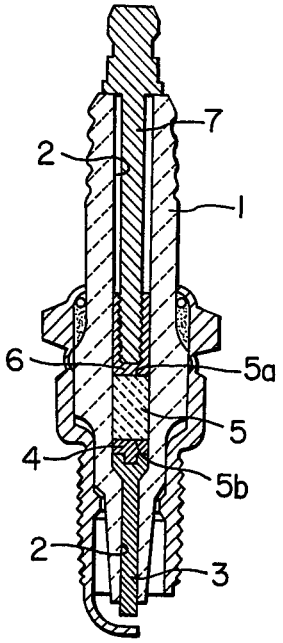
7
2
1
6
5a
5
4
5b
2
3

RESISTOR COMPOSITION FOR RESISTOR-INCORPORATED SPARK PLUGS

BACKGROUND OF THE INVENTION

The present invention relates to a resistor composition for resistor-incorporated spark plugs and, more specifically, to improvements in the resistance properties of the resistor composition upon sealing.

Generally, conventional resistor compositions for resistor-incorporated spark plugs have been basically made up of a mixture of inorganic components (hereinafter referred to as the base mixture), viz., glass frit and inorganic aggregate, the said aggregate substantially comprising alumina, zircon, mullite, silica, fused silica, clay, magnesia, silicon mitride, boron nitride, aluminium nitride or the like or a mixture of two or more of these substances, and a carbonaceous material including carbon black, acetylene black, graphite or other organic substance capable of being carbonized by calcination or sealing by heating such as, for instance, glycerol, methyl cellulose, polyvinyl alcohol and the like. To further improve the service life under discharge load of the resistor, one may use per 100 parts by weight of the aforesaid base mixture, 0 to 30 parts by weight of one or more components selected from the group consisting of the oxides and carbides of rare earth elements and metals (Ti, Nb, Cr, etc.) from Subgroups IVa, Va and VIa of the long period type periodic table (Iwanami Rikagaku Jiten, third edition, pp. 1484–5) and the carbides of B or Si.

As illustrated in the accompanying single drawing, a center bore 2 of a refractory insulator 1 forming part of a spark plug is charged with such resistor compositions, which are usually sealed between a center electrode 3 and a terminal rod 7 by means of conductive sealing glass powders 4 and 6 to form a resistor body 5.

This resistor body has to be sealed so as to attain a given resistance value with a view to preventing the occurrence of radio frequency interference on ignition of the spark plug. However, conventional resistor compositions have varying resistance values depending upon the magnitude of sealing temperature, and render it difficult to obtain a desired constant resistance value, thus requiring stringent sealing temperature control for their preparation.

SUMMARY OF THE DISCLOSURE

It is therefore a main object of the present invention to provide a novel resistor composition for resistor-incorporated spark plugs, which has a reduced variation in the resistance value depending upon sealing temperature.

In an effort to achieve this object, it has been found that variation of the resistance depending upon sealing temperature is caused by foaming to form minute pores during and upon sealing, substantially attributable to the absence of a boric acid component in the resistor composition.

The present invention has been accomplished on the basis of such findings, and is characterized by including one or more of boron oxide, boric acid and borate in the resistor composition.

In accordance with another aspect of the present invention, variation upon sealing in the resistance value of the resistor body can be reduced further by carbonizing beforehand a portion of 1% or higher of the aggregate of the resistor composition by calcination of a mixture of that portion with an organic carbonaceous substance(s). The remainder of the aggregate may then be made up of that as used in the art. In the resistor comosition, the amount of carbon derived from the calcined and carbonized aggregate portion should be at least 0.1 part by weight or higher, preferably 0.5–3 parts by weight, per 100 parts by weight of the inorganic base mixture. Although all of the carbon content may be derived from the calcined aggregate portion, it is recommendable that a portion of the carbon be derived from an identical or different organic carbonaceous material used as a binder, more preferably a water-soluble carbonaceous material. For the mixing of the organic carbonaceous material with the aggregate as well as the calcination and carbonization of the resulting mixture, reference should be made to applicants copending application Ser. No. 514,327, filed July 15, 1983.

BRIEF DESCRIPTION OF THE DRAWING

The foregoing and other objects and features of the present invention will become apparent from the following detailed description with reference to the accompanying drawing, in which:

A single FIGURE is a sectional view showing one embodiment of the spark plug in which its centere bore is charged with the resistor composition according to the present invention.

DETAILED DISCLOSURE OF THE PREFERRED EMBODIMENTS

As the binder for resistor-incorporated spark plugs, various types of glasses such as, for instance, borosilicate glass, barium borate-base glass, lead glass, etc. are used. Especially, BaO-containing glass is especially preferable since it shows good compatibility with respect to carbonaceous materials. Preferably, the glasses used have a softening point exceeding about 300° C. Too low a softening point poses some problems. For instance, when used with an actually working engine, it is difficult to secure the tight bonding between the center electrode and the terminal rod in place with the resistance value fluctuating. The glasses used in the present invention are prepared in the known manner, pulverized to a suitable particle size and made into frits.

According to the present invention, the base mixture (glass plus inorganic aggregate) in the overall inorganic ingredients contains 30 up to 70% by weight of glass. If the glass content is below 30% by weight, insufficient bonding takes place among the aggregate so that the resulting resistor is too porous, adversely affecting its airtightness and service life under load. Besides, one may encounter difficulties in insertion of the terminal rod (a male screw) and in bonding of the resistor composition to the inner wall of the insulator centerbore.

On the other hand, if the glass content exceeds 70% by weight, the glass may enter voids among carbon particles which should serve as a conductive material with the result that the resistance value increases and varies greatly. In addition, the interfacial plane between the resistor body 5 and conductive sealing glass becomes not at a right angle with respect to the longitudinal axis of the insulator centerbore 2 on hot-pressing thereof, wherein the upper and lower interfaces or end faces 5*a* and 5*b* of the resistor body are sphered, resulting in an effective length l being shorter than a given design length l'. This renders it difficult to obtain the desired resistance, and leads to deterioration in the desired noise suppression effect.

The inorganic aggregate includes oxides, silicate minerals, etc., either crystalline or non-crystalline, which are usually used as ceramic raw materials such as, for instance, alumina, zircon, mullite, fused silica, magnesia, silica and clay, and encompasses electrically poor-conductive, heat-resistance substances. In addition to the substances, hereinabove mentioned, the aggregate should preferably contain at least one of a nitride such as, for instance, silicon nitride, boron nitride and aluminium nitride.

These inorganic aggregates are added to the resistor body with a view to providing heat resistance thereto and preventing it from being sphered. In particular, the addition of the nitrides in an amount of 0.1% by weight or more is effective in further improving the noise suppression effect.

As well-known in the art, a given amount of the carbonaceous material (inclusive of carbon black, acetylene black, graphite, powdery pitch and organic substances capable of being carbonized during sintering) is added to the resistor body for the purpose of regulating the resistance value thereof, in addition to the above-mentioned base mixture. The amount of the carbonaceous material added is 0.1–10% by weight, preferably 0.5–3% by weight (calculated as carbon) per 100 parts by weight of the base mixture. In general, the resistance value will increase excessively if the carbonaceous material is less than 0.1% by weight, whereas it will decrease excessively with a drop of the noise suppresion effect, if present in an amount exceeding 10% by weight.

Preferably, the organic substance capable of being carbonized during sintering should also serve as a binder for the powdery composition for resistor bodies, and known organic binder substances are used for that purpose.

For instance, use may be made of dextrin, CMC, methyl cellulose, glycerol, sucrose, lactose, maltose, glucose, xylose, PVA and the like, or a lubricating binder such as, for example, paraffin wax.

Preferably, the resistor composition according to the present invention contains an agent for stabilizing the service life of the resistor under load (stabilizing agent), viz., for stabilizing a change in resistance value with time during use, in a quantity of 0 to 30 parts by weight per 100 parts by weight of the aforesaid base mixture. Although this stabilizing agent is identical with that to be added to a conductive sealing glass material as disclosed in Japanese Laid Open Application No. 50-27985, Japanese Laid Open Application Nos. 50-27983 and 50-27984 have revealed that a similar effect is attained by adding it to the resistor composition per se.

Even where this stabilizing agent is added, the amount of glass contained in the base mixture should preferably be 30% by weight or more of the total inorganic substances in the resistor composition.

As disclosed in the foregoing Laid Open Application No. 50-27985, it is noted that said stabilizing agent is preferably added to a conductive sealing glass to be used, for sealing the resistor body, contiguous to the end of the resistor body.

As the boric acid component, use may be made of boron oxide, boric acid or a salt of boric acid.

With a view to preventing formation of minute pores in the resistor during sealing by heating, one or more of these boric acid components are added in an amount of 0.1 to 15 parts by weight per 100 parts by weight of the base mixture. As the borate, salts of Ca, Na, K, Ba, Li, etc., mixed salts thereof, or a mixture thereof may be used.

It is understood that the boric acid component effectively used in the present invention excludes the boron oxide contained as one glass component in the glass.

Preferably, the boric acid component includes boric acid, anhydrous boron oxide or a borate such as, for instance, calcium borate, borax or sodium borate. Preferably, the boric acid component should be added in an amount of 0.1 to 15 parts by weight, more particularly 1 to 7 parts by weight (per 100 parts by weight of the base mixture.)

Upon sintering, the resistor according to the present invention has a specific resistance of approximately 10 to $1\times10^3\Omega$cm. Usually, sintering and compression (hot-preseing) are effected in such a manner that a resistor having a specific resistance of approximately 1 to 10K$\Omega$, occasionally 0.2–20K$\Omega$ and more generally 3 to 7.5K$\Omega$, is obtained in the insulator centerbore, The hot-pressing applied in the present invention comprises the steps of inserting or forming beforehand a center electrode or an alternative electrode member 3 in the insulator cneterbore 2, charging the centerbore 2 with a conductive sealing glass 4, a resistor composition 5 and, again, a conductive sealing glass 6 at a pressure of about 1500 to 2000 kg/cm$^2$, respectively, then inserting a terminal rod 7 therethrough and heating it to 900° to 1000° C. to put the glass in a softened state, and hot-pressing the terminal rod along its axial direction under a load of about 30 to 70 kg weight. It is noted that the conductive sealing glass used has a sealing temperature coincident with that of the resistor.

The resultant resistor-incorporated spark plug undergoes little or no fluctuation in resistance dependent upon its heating (sealing) temperature, can easily be controlled in the heating procedure, is of constant quality, and can be manufactured with improved yields. According to the present invention, therefore, it is possible to achieve faithful reproduction of the resistance corresponding to the predetermined constant composition, thus facilitating or simplifying the production and design of resistor-incorporated spark plugs.

To further reduce variation of the resistance value of the resistor composition containing the aforesaid boric acid component(s), the aggregate is partly or wholly mixed with the carbonaceous substance in advance, followed by calcination and carbonization.

Preferably, calcination should be effected with a mixture of the aggregate having good adsorptivity (e.g., mullite, clay, fused silica, silica or the like) with the carbonaceous material in an oxygen poor atmosphere. When clay etc. is used as the aggregate to be calcined, a sufficient effect is usually obtained if a portion of that aggregate is precalcined for carbonization.

As the carbonaceous substance, use may be made of a water-soluble binder such as methyl cellulose, gum arabic, PVA or the like. In addition, CMC, glycerol, dextrin, succrose, lactose, maltose, xylose or the like, or a lubricating binder such as paraffin wax may be used. The water-soluble carbonaceous substance may optionally be diluted with water or other solvent for use.

The binder should preferably be used according to the prior art, if the resistor composition in the centerbore or its pre-forming (by pressing etc.) for that purpose is taken into consideration. According to the present invention, however, the binder may be employed so that the carbon derived from the binder constitutes the remainder of the carbon derived from the calcined aggregate. Although the binder is preferably a water-soluble carbonaceous substance, other known lubricating organics such as paraffin wax may be employed.

Mixing prior to calcination may be effected with the organic carbonaceous material diluted with water or other solvent, if required.

Calcination is usually effected approximately at 500°-1300° C., preferably 500°-1200° C. in an oxygen poor atmosphere. Although the calcination temperature is not critical, it is generally in the aforesaid range.

It is understood that the remainder of the aggregate which is not calcined may be one known in the art.

The present invention will be elucidated with reference to the following non-restrictive examples, wherein % and part(s) are given by weight ratio. It should be understood that the present invention is not limited to the disclosed embodiments and any modifications suitable in the art may be done without departing from the concept and scope of the present invention.

EXAMPLE 1

The glasses having the compositions as shown in Table 1 were prepared beforehand, finely pulverized and sieved out on a JIS 150 mesh. The thus sieved-out particles were then fritted.

TABLE 1

| Glass | PbO | $SiO_2$ | $B_2O_3$ | BaO | ZnO |
|---|---|---|---|---|---|
| A | 60 | 25 | 15 | | |
| B | | 5 | 60 | 35 | |
| C | | 38 | 26 | 16 | 20 |

A number of resistor compositions (Test Pieces Nos. 2-4, 6-10, 12, 14 and 16-18) were prepared having he compositions as set forth in Table 2. $H_3BO_3$ (in parts per 100 parts of the base mixtures of glass and aggregates) was applied in such amounts as specified in Table 2, and methyl cellulose was applied as the carbonaceous material in such amounts that the resistance value upon sealing was about 5KΩ on the average. These components were mixed together in a ball mill for 3 hours.

Especially, Test Pieces Nos. 17 and 18 contained as the aforesaid stabilizing agent $TiO_2$ and TiC, respectively. 0.5 grams of each resistor composition were then charged with in a centerbore 2 in a porcelain insulator 1 together with upper and lower conductive glass seals, each weighing 0.2 grams, as shown in the accompanying drawing. For each piece 50 spark plugs under test were made, of which the resistance values upon sealing were measured to determine dispersions thereof. $\sigma/\chi\bar{\times}100$ where $\sigma$ is standard deviation and $\bar{\chi}$ is the mean resistance value gives the dispersions of the resistance values as set out in Table 2.

Table 2 also shows the service life characteristics under load which are defined in terms of a change in the resistance values between the electrode rod and the terminal rod of each spark plug measured at normal temperature and at that temperature after 250 hours spark testing carried out according to JIS D 5102.4.4.11.

TABLE 2

| No. | Glass | Aggregate | | Boric acid components | | Other components | Dispersion of R value $\sigma/\chi \times 100$(%) | Service life characteristics under load (at normal temp. for 250 hours) JIS |
|---|---|---|---|---|---|---|---|---|
| R1 | A 60 | $Si_3N_4$ | 40 | $H_3BO_3$ | 0 | | 15.3 | −5 to −15 |
| 2 | " | " | | " | 0.1 | | 11.4 | −6 to −15 |
| 3 | " | " | | " | 5 | | 6.5 | −8 to −20 |
| 4 | " | " | | " | 15 | | 7.1 | −18 to −23 |
| R5 | " | " | | " | 17 | | 10.3 | −20 to −33 |
| 6 | " | " | | $B_2O_3$ | 5 | | 8.1 | −10 to −21 |
| 7 | " | " | | borax | 5 | | 7.7 | −12 to −20 |
| 8 | " | " | | calcium borate | 5 | | 7.3 | −8 to −19 |
| 9 | B 40 | $Si_3N_4$ | 60 | $H_3BO_3$ | 5 | | 9.0 | −15 to −20 |
| 10 | C 50 | " | 50 | " | 5 | | 8.4 | −15 to −21 |
| R11 | A 60 | clay | 40 | " | 0 | | 17.7 | −8 to −15 |
| 12 | " | " | " | " | 5 | | 11.5 | −9 to −19 |
| R13 | " | zircon | " | " | 0 | | 16.4 | −6 to −11 |
| 14 | " | " | " | " | 5 | | 10.2 | −13 to −18 |
| R15 | " | $Si_3N_4$ | 12.5 | " | 0 | | 14.6 | −5 to −9 |
| | | fused silica | 12.5 | | | | | |
| 16 | " | " | | " | 5 | | 6.3 | −5 to −15 |
| 17 | " | $Si_3N_4$ | 40 | " | 5 | $TiO_2$ 5 | 7.5 | −10 to −12 |
| 18 | " | " | " | " | 5 | TiC 3 | 7.9 | −14 to −18 |

As will be apparent from Table 2, the spark plugs made of the resistor materials without the boric acid component have greatly varying resistance values.

COMPARATIVE EXAMPLE 1

In Table 2, the pieces with affixes "R" indicate control pieces (R1, R11, R13 and R15). Prepared were control resistor materials having the compositions as set forth in Table 2, containing methyl cellulose as the carbonaceous material and not containing any boric acid component such as boric acid or a borate, which were then charged with in porcelain insulators under the same conditions as those in Example 1 followed by hot-pressing. Similar measurements were made on the thus obtained spark plugs. The results are given in Table 2.

One specific piece (R5) containing much boric acid was prepared and measured according to Example 1.

A comparison of Example 1 with Comparative Example 1 reveals that there is a large difference in the resistance value variation between the resistor materials containing boric acid components and those not containing any boric acid components.

EXAMPLE 2

Clay and glycerol in a weight proportion of 2:1 were calcined at 700° C. for 2 hours in an oxygen poor atmosphere resulting in a calcined aggregate (clay) having a carbon content of 13% by weight. Various resistor compositions were prepared from the thus calcined aggregate and other specific aggregate in the proportion as specified in Table 3, and sealed and measured according to Example 1. The results are also given in Table 3.

TABLE 3

| | Glass* | Normal aggregate* | Calcined aggregate* | Carbonaceous material derived from binder* | Boric acid component | Dispersion of R value $\sigma/\chi \times 100(\%)$ | Resistance characteristics under load $250^{MHz}_{Hr}$ JIS |
|---|---|---|---|---|---|---|---|
| 19 | A 60 | $Si_3N_4$ 25 | 15 | Methyl cellulose 0.5 | 5 | 5.2 | −8 to −18 |
| 20 | " | 39.6 | 0.4 | 3.0 | 5 | 12.0 | −5 to −13 |
| 21 | " | 39 | 1 | 2.8 | 5 | 10.5 | −5 to −15 |
| 22 | " | 37 | 3 | 2.5 | 5 | 9.8 | −7 to −20 |
| 23 | " | 2 | 38 | 0.05 | 5 | 5.3 | −15 to −25 |
| 24 | " | 0 | 40 | 0 | 5 | 5.3 | −18 to −26 |
| 25 | " | 25 | 15 | 0.5 | 0.1 | 5.3 | −6 to −12 |

Note
*parts by weight

What is claimed is:

1. A resistor composition for resistor-incorporated spark plugs comprising:

100 parts by weight of a base mixture composed of 30–70% by weight of glass frit with the balance being an inorganic aggregate comprising alumina, zircon, mullite, silica, fused silica, magnesia, clay, silicon nitride, aluminium nitride, boron nitride or mixtures thereof;

0.1–10.0 parts by weight of a carbonaceous material calculated as carbon upon calcination;

0–30 parts by weight of a stabilizing agent for resistance under load consisting of one or more selected from the group consisting of oxides and carbides of rare earth elements and metals from Subgroup IVa, Va and VIa of the periodic table, ZnO, $B_4C$, SiC, TiB and TiN; and, 0.1 to 15 parts by weight of one or more of boron oxide, boric acid and a borate.

2. A resistor composition for resistor-incorporated spark plugs comprising:

100 parts by weight of a base mixture composed of 30–70% by weight of glass frit with the balance being an inorganic aggregate comprising alumina, zircon, mullite, silica, fused silica, magnesia, clay, silicon nitride, aluminum nitrides, boron nitride or mixtures thereof;

0.1–10.0 parts by weight of a carbonaceous material calculated as carbon upon calcination;

0–30 parts by weight of a stabilizing agent for resistance under load consisting of one or more selected from the group consisting of oxides and carbides of rare earth elements, and metals from Subgroups IVa, Va and VIa of the periodic table, ZnO, $B_4C$, SiC, TiB and TiN;

0.1 to 15 parts by weight of one or more of boron oxide, boric acid and a borate; and 1–100% by weight of said aggregate being mixed and calcined with said carbonaceous material prior to being mixed with the remaining ingredients of the resistor composition.

3. The resistor composition of claim 2, wherein the calcination is carried out at a temperature of 500°–1300° C.

* * * * *